US010953450B2

(12) United States Patent
Avrillaud et al.

(10) Patent No.: US 10,953,450 B2
(45) Date of Patent: Mar. 23, 2021

(54) ELECTROHYDRAULIC FORMING DEVICE COMPRISING AN OPTIMIZED CHAMBER

(71) Applicant: ADM28 s.àr.l, Luxembourg (LU)

(72) Inventors: Gilles Avrillaud, Pinsaguel (FR); Julien Fuzeau, Toulouse (FR)

(73) Assignee: ADM28 s.àr.l, Luxembourg (LU)

( * ) Notice: Subject to any disclaimer, the term of this patent is extended or adjusted under 35 U.S.C. 154(b) by 533 days.

(21) Appl. No.: 15/540,940

(22) PCT Filed: Dec. 29, 2015

(86) PCT No.: PCT/EP2015/081377
§ 371 (c)(1),
(2) Date: Sep. 14, 2017

(87) PCT Pub. No.: WO2016/107884
PCT Pub. Date: Jul. 7, 2016

(65) Prior Publication Data

US 2018/0021837 A1 Jan. 25, 2018

(30) Foreign Application Priority Data

Dec. 29, 2014 (FR) ..... 1463411

(51) Int. Cl.
*B21D 26/12* (2006.01)

(52) U.S. Cl.
CPC ..... *B21D 26/12* (2013.01)

(58) Field of Classification Search
CPC .... B21D 26/02; B21D 26/031; B21D 26/047; B21D 26/06; B21D 26/08; B21D 26/10; B21D 26/12; Y10T 29/49805; Y10T 29/49806
USPC ..... 72/56
See application file for complete search history.

(56) References Cited

U.S. PATENT DOCUMENTS 2,559,227 A * 7/1951 Rieber ..... A61H 23/008 601/4
3,163,141 A 12/1964 Wesley et al.
3,188,844 A * 6/1965 Schwinghamer ..... B21D 26/10 72/56
3,195,334 A * 7/1965 Filler ..... B21D 26/08 72/56

(Continued)

FOREIGN PATENT DOCUMENTS

JP S38-8695 B 6/1963
JP 52023776 A * 2/1977
JP S52-23776 A 2/1977

OTHER PUBLICATIONS

Machine translation of JP52-023776, 4 Pages. (Year: 1977).*

(Continued)

*Primary Examiner* — Gregory D Swiatocha
(74) *Attorney, Agent, or Firm* — Seed Intellectual Property Law Group LLP

(57) ABSTRACT

An electrohydraulic forming device includes a mold, a tank having a first wall, and a first electrode and second electrode both placed in the tank and adapted to generate an electrical discharge to create at least one pressure wave. The first wall is rotationally symmetric about an axis of revolution, the electrodes have axes of revolution that are coincident with the axis of revolution of the first wall, and the first wall has a concavity oriented towards the mold.

18 Claims, 4 Drawing Sheets

(56) References Cited

Figure 1:
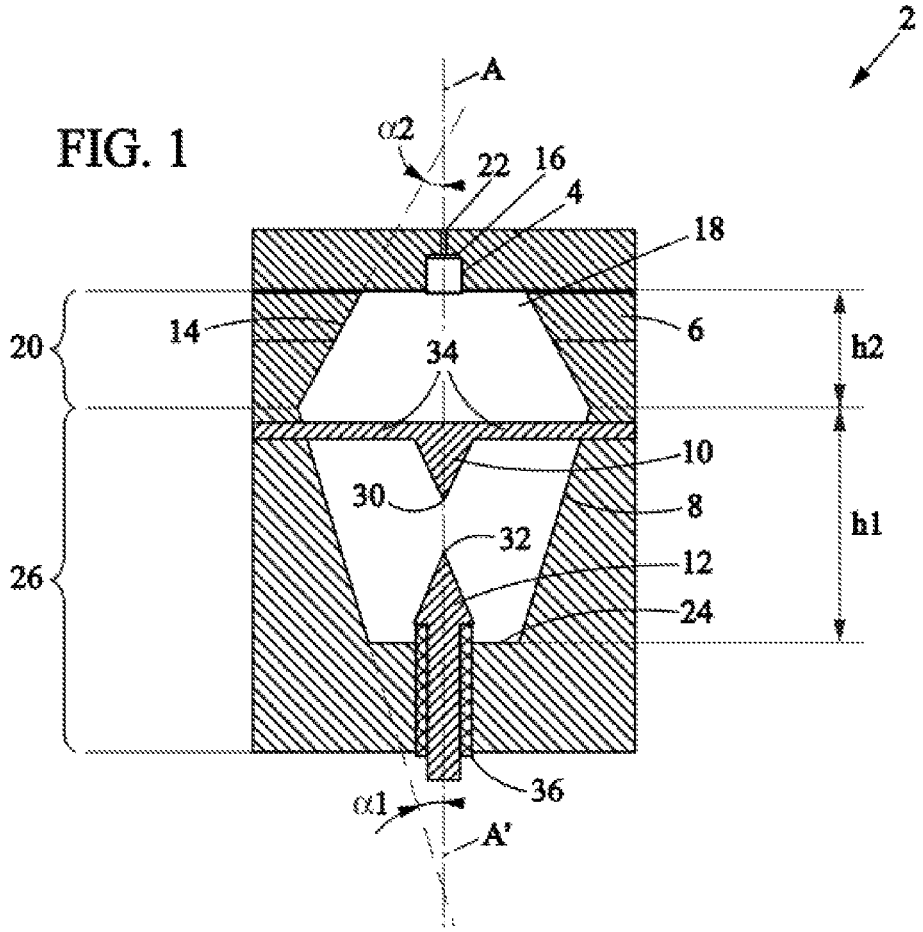

U.S. PATENT DOCUMENTS 3,232,085 A * 2/1966 Inoue ..... B21D 26/12 72/56
3,358,487 A * 12/1967 Brejcha ..... B21D 26/12 72/56
3,486,062 A * 12/1969 Schrom ..... G10K 15/06 367/147
3,491,564 A * 1/1970 Hundley ..... B21D 26/12 72/56
3,631,700 A * 1/1972 Kosaka ..... B21D 26/12 72/56
4,027,515 A * 6/1977 Chachin ..... B21D 26/08 72/56
4,068,514 A * 1/1978 Chachin ..... B21D 26/12 72/454
5,256,430 A * 10/1993 Suzuki ..... B23K 20/08 204/157.15
6,591,649 B1 7/2003 Gafri et al.
7,802,457 B2 9/2010 Golovaschenko et al.
7,827,838 B2 * 11/2010 Golovashchenko ..... B21D 22/205 29/421.1
2008/0134741 A1 * 6/2008 Golovashchenko ... B21D 26/12 72/63
2009/0272167 A1 * 11/2009 Golovashchenko ..... B21D 22/205 72/56
2010/0154502 A1 6/2010 Johnson-Morke et al.
2014/0053622 A1 2/2014 Bonnen et al.
2016/0271676 A1 * 9/2016 Avrillaud ..... B21D 26/12

OTHER PUBLICATIONS

International Impulse Forming Group, "Working Media based High Velocity Forming," 6 pgs., 2016, http://i2fg.org/impulse-forming/working-media-based-high-velocity-forming/.

* cited by examiner

ELECTROHYDRAULIC FORMING DEVICE COMPRISING AN OPTIMIZED CHAMBER

The present invention relates to an electrohydraulic forming device with optimized chamber.

Over the last decade, hydraulic forming processes have been used in many industries. Due to advancements in these manufacturing processes, it is now possible to obtain mechanical parts of relatively complex form, with competitive production costs.

A hydraulic forming process is a process of manufacturing by deformation. It enables plastic deformation of a metal part of relatively small thickness. To achieve this deformation, a fluid is used which, when pressurized, enables the deformation of said part on a mold. Several techniques are used to pressurize the fluid.

One of the processes used is an electrohydraulic forming process. This process is based on the principle of an electrical discharge in fluid stored in a tank. The released amount of electric energy generates a pressure wave which propagates very quickly in the fluid and enables plastic deformation of the mechanical part against the mold. Electrodes positioned in the fluid make it possible to release an electric charge stored in energy storage capacitors.

U.S. Pat. No. 6,591,649 discloses an electrohydraulic forming device. This device comprises a tank of substantially elliptical shape closed off by a mold, and a set of electrodes coupled to an electric energy storage device. The set of electrodes is placed in the tank parallel to the mold and is adapted to generate an electric arc in order to create pressure waves that will directly deform a workpiece placed facing the mold.

The manufacture of parts having high precision details is possible with electrohydraulic forming, but requires a significant amount of energy or multiple electrical discharges. Optimizing the amount of energy to be delivered makes it possible both to reduce the size of the generator and thus the necessary investments, as well to reduce as the mechanical stresses applied to the tools, in particular the discharge chamber and the electrodes. Repetition of the discharges significantly increases production times and thus increases production costs. Moreover, in spite of the increase in energy or the repetition of the discharges, the results obtained from the production of high-form-factor parts by electrohydraulic forming are sometimes not very good and certain high precision details can only be obtained with great difficulty. The form factor is defined by a ratio between the surface area occupied by the part to be formed and the height of said part.

One object of the present invention is thus to provide an electrohydraulic forming device which enables the manufacture of parts with high precision and/or a high form factor, with less energy or with a reduction in the number of discharges required. The investments, production costs, and possibly the production times are thus reduced.

In addition, another object of the present invention is to provide an electrohydraulic forming device having improved reliability and an improved service life compared to devices of the prior art. Advantageously, it will be easy to use and will have a competitive production cost.

To this end, the invention proposes an electrohydraulic forming device comprising a mold, a tank having a first wall, and a first electrode and second electrode both placed in the tank and adapted to generate an electrical discharge to create at least one pressure wave.

According to the invention, the first wall is rotationally symmetric about an axis of revolution, the electrodes have axes of revolution coincident with the axis of revolution of the first wall, and the first wall has a concavity oriented towards the mold.

Thus, unlike electrohydraulic forming devices of the prior art, where direct waves are primarily used to deform the part to be formed, here, due to the geometry of the tank and the positioning of the electrodes, indirect pressure waves are facilitated in order to deform said part to be formed. In the manner of a concave mirror, the first wall tends to converge the pressure waves reflected by it towards the mold.

In one exemplary embodiment, the first wall is of conical or frustoconical shape, improving the concentration of the indirect pressure waves in order to increase the moment of pressure applied to the part to be formed.

In order to precisely control the direction of the indirect waves, the first wall has a half-angle at the apex having a value between 20° and 35°.

In order to manufacture parts with large form factors, the tank advantageously comprises a second wall situated between the mold and the first wall.

To concentrate the indirect waves, the second wall is preferably of frustoconical shape. To avoid interfering with propagation of the indirect waves and to improve the concentration of these waves, the second wall has a half-angle at the apex having a value between 20° and 35°.

In another exemplary embodiment, the second wall is of paraboloid shape, making it possible to slow the arrival of the indirect waves on the part to be formed.

One advantageous embodiment of the invention provides that the electrodes are arranged in line with one another, an inter-electrode space remaining between them. The electric arcs formed between the electrodes thus connect the two electrodes and are substantially parallel to them and therefore also to the axis of revolution of the first wall. In addition, the electrodes are advantageously arranged at the height of the first wall with respect to the axis of revolution. This arrangement further encourages the pressure waves reaching the mold as primarily being waves reflected on the first wall.

Preferably, the inter-electrode space separating the first electrode from the second electrode is adjustable in order to be able to adapt the device to different molds.

To improve the service life and reliability of the tank, it is made of a metal or a metal alloy.

Figure 3:
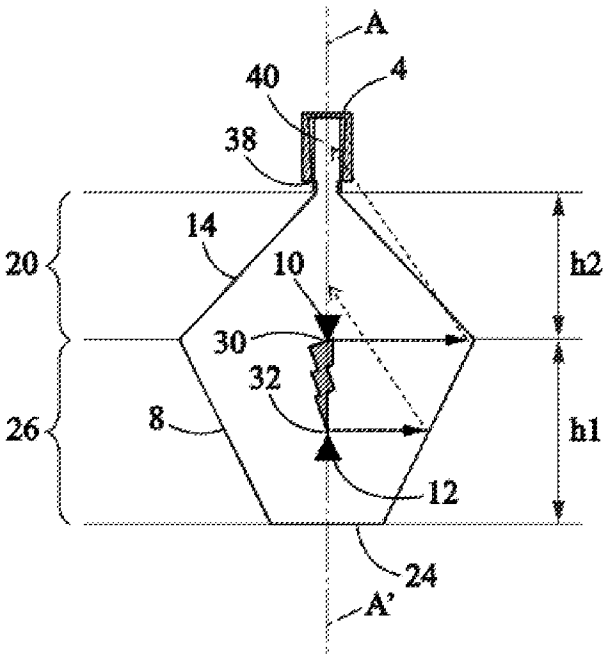
Figure 2:
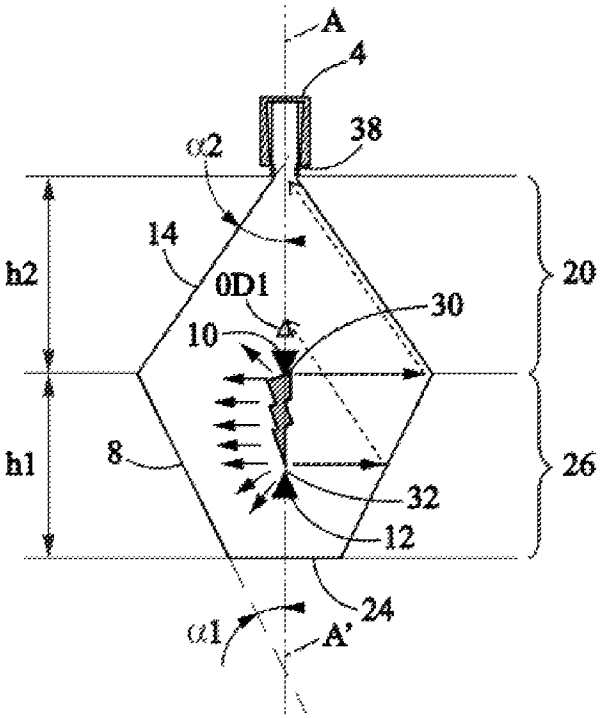
Figure 5:
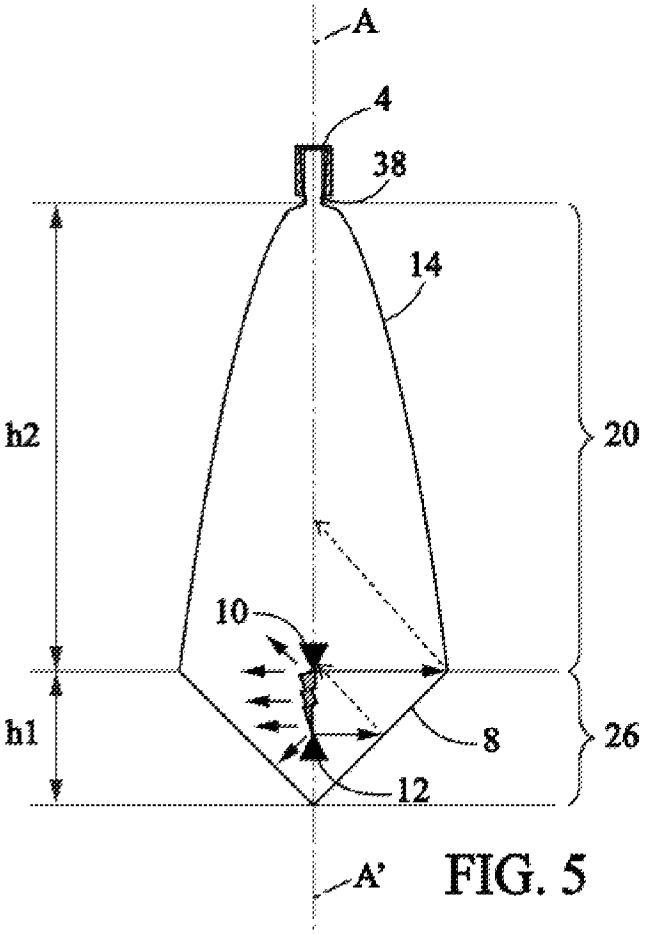
Figure 4:
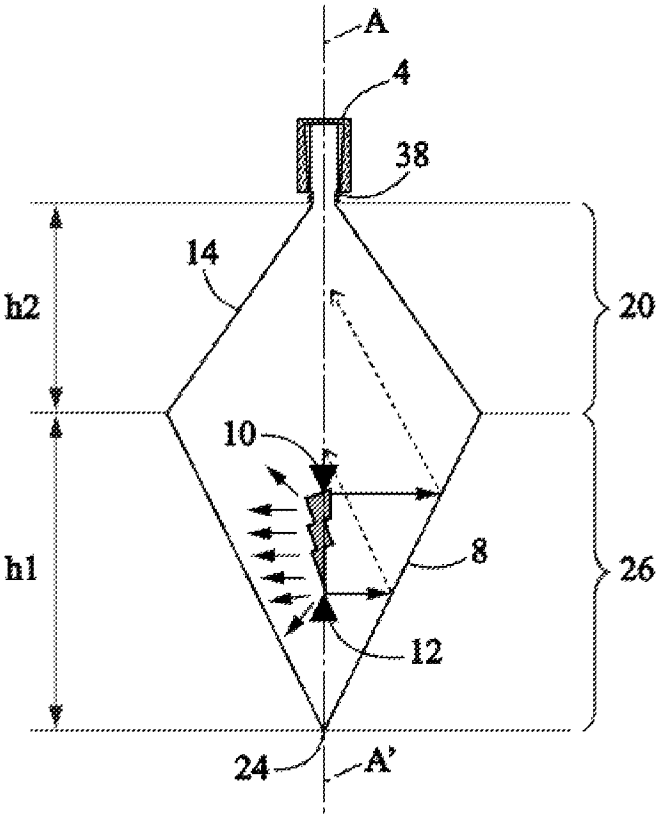
Figure 6:
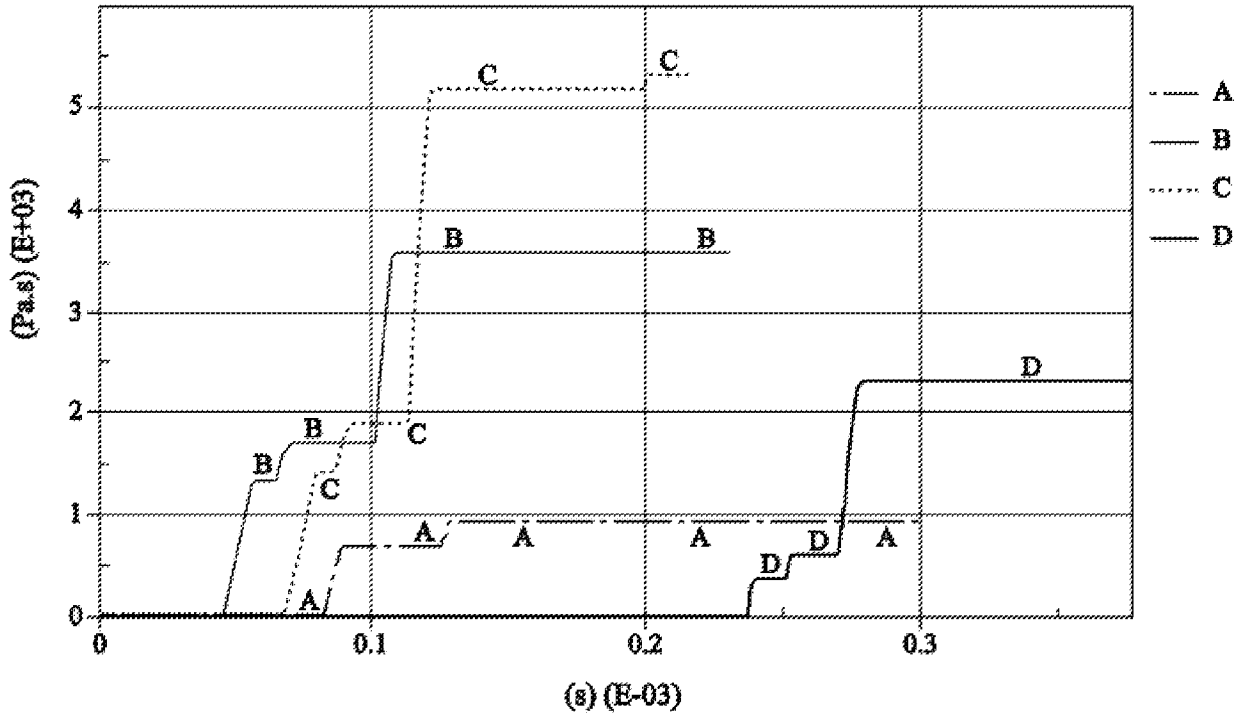

Features and advantages of the invention will be more apparent from the following description, made with reference to the accompanying schematic drawing in which:

FIG. 1 is a schematic cross-sectional view of an electrohydraulic forming device according to the invention, FIGS. 2 to 5 are each a simplified schematic view of a chamber according to a variant embodiment of the electrohydraulic forming device of FIG. 1, and FIG. 6 is a comparative graph representing the performances of an electrohydraulic forming device of the prior art and each of the variant embodiments presented in FIGS. 2, 3, and 5.

The attached drawing concerns an electrohydraulic forming device 2 which comprises a mold 4 positioned on a tank 6 containing a fluid 18, and at least a first electrode 10 and second electrode 12 both positioned in the tank 6. FIG. 1 shows a simplified cross-sectional view of this electrohydraulic forming device 2.

The mold 4 has a lower portion 38 and a mold center 40. It is shaped to enable the creation of a part to be formed 16 which may have a large form factor with high precision details. Depending on the conformation of the part to be formed 16, the mold 4 may for example be cylindrical in shape. Preferably, the mold 4 is positioned on an upper portion 20 of the tank 6 and is removable.

The mold 4 comprises piping 22 coupled to vacuum means (not shown in the figures) for eliminating any presence of air between the part to be formed 16 and the mold 4. Thus, during the process of forming the part to be formed 16, there is no counter-reaction (caused by the presence of air between the part to be formed 16 and the mold 4) to oppose the deformation of the part to be formed 16.

The tank 6 is adapted to contain the fluid 18, which is preferably water. Optionally, piping (not represented in the figures) may be used to maintain a constant fluid level in the tank 6. Preferably, the tank 6 is composed of a high density material, for example such as a metal or a metal alloy.

The tank 6 comprises a first wall 8 and a tank bottom 24, both located in a lower portion 26. It also comprises a second wall 14 located in the upper portion 20 (FIG. 1). The first wall 8 and second wall 14 meet in a joining region as shown in FIG. 1.

In the embodiments of FIGS. 1 to 3, the tank bottom 24 is of planar shape and is parallel to a plane of separation between the tank 6 and the mold 4. The first wall 8 and the second wall 14 have a rotationally symmetric shape about an axis of revolution A-A' as shown in FIG. 1.

The first wall 8 has a concave shape. The concavity of this wall is oriented towards the mold 4. The first wall 8 then forms, possibly with the bottom of the tank 24, a hollow space oriented towards the mold 4. In a preferred embodiment, the first wall 8 is frustoconical, of axis A-A', and has a half-angle $\alpha 1$ at the apex (FIG. 1). The second wall 14 is also of frustoconical shape, of axis A-A', and has a half-angle $\alpha 2$ at the apex (FIG. 1). The value of half-angle $\alpha 1$ at the apex is between 20° and 35°. The value of half-angle $\alpha 2$ at the apex is between 20° and 35° and may be different from the value of the half-angle $\alpha 1$ at the apex. Starting from the bottom of the tank 24, the first wall 8 is not parallel to the axis of revolution A-A' but due to its concavity diverges towards the mold 4 while the second wall 14 converges towards the mold 4.

The first wall 8 has a height h1 and the second wall 14 has a height h2 (FIG. 1). The heights h1 and h2 are determined during manufacture of the tank 6 so that the characteristics of the electrohydraulic forming device 2 correspond to the characteristics of the given specifications.

The first electrode 10 and the second electrode 12 each have an axis of revolution. The axes of revolution of the first electrode 10 and of the second electrode 12 are coincident with the axis of revolution A-A' of the first wall 8. The electrodes are arranged in line with one another so that the electric arc generated between the first electrode 10 and the second electrode 12 is thus close to the axis of revolution A-A'.

The first electrode 10 is a high voltage electrode (several tens of kV). It is maintained on the axis of revolution A-A' by means of at least two retaining arms 34. The retaining arms 34 may be made of metal or a synthetic material and are fixed to the tank 6. When the retaining arms 34 are made of metal, they are insulated from the tank 6 in order to prevent electric arcs from traveling between the retaining arms 34 and the tank 6.

The second electrode 12 is fixed to the tank bottom 24. It is implemented as a metal part and is at the same potential as the tank 6. Insulation 36 may be installed between the tank 6 and the second electrode 12. In one example embodiment, the tank 6 and the second electrode 12 are coupled to the electrical ground.

The first electrode 10 has a first tip 30 and the second electrode 12 has a second tip 32. An adjustable inter-electrode space, corresponding to the spacing between the first tip 30 and the second tip 32, allows controlling the triggering of the electric arc between the first electrode 10 and the second electrode 12. The inter-electrode space is adjusted so that it is less than the distance separating the first tip 30 from the first wall 8.

An electrical storage device (not shown in the figures) is used that is suitable for storing a sufficient amount of electric energy at a voltage which is also sufficient (typically from 1 kV to 100 kV) to generate at least one electric arc between the first electrode 10 and the second electrode 12 and to deform the part to be formed 16.

In order to control the duration and amount of electric energy delivered by the electric energy storage device to the first electrode 10 and the second electrode 12, a pulse generator (not shown in the figures) is coupled to the energy storage device. As the pulse generator and the electric energy storage device are known to those skilled in the art, they will not be presented in the remainder of the description.

For clarity in the description, FIGS. 2 to 5 represent the first electrode 10, the second electrode 12, the tank 6, and the mold 4 in a simplified and schematic manner. The electric arc between the first electrode 10 and the second electrode 12 is also schematically represented. The electric arc is never rectilinear nor identical from one occurrence to another but in general the electrodes are arranged so that the electric arc is substantially parallel to the axis of revolution A-A'.

The electric arc generated between the first electrode 10 and the second electrode 12 gives rise to direct pressure waves. These direct pressure waves move concentrically around the inter-electrode space and a direct pressure wave (OD1 in FIG. 2) propagates in the direction of the first wall 8. These direct pressure waves are represented in FIGS. 2 to 5 by solid arrows.

In order to deform a part to be formed 16 having large details and/or a large form factor, an electrohydraulic forming device 2 is proposed having a first wall 8 with a half-angle $\alpha 1$ at the apex such that the maximum direct pressure waves striking the first wall 8 of the vessel 6 give rise to indirect pressure waves (represented schematically by dotted lines) which propagate towards the axis of revolution A-A' in the direction of the bottom portion 38 of the mold 4.

For example, a direct pressure wave originating from the first tip 30, (FIG. 2) which is moving parallel to the tank bottom 24 towards the first wall 8, is reflected (angle $\alpha 1$) and gives rise to an indirect wave which moves towards the axis of revolution A-A' in the direction of the lower portion 38 of the mold 4.

Similarly, a direct pressure wave originating from the second tip 32 (FIG. 2), which is moving parallel to the tank bottom 24 towards the first wall 8, is reflected (angle $\alpha 1$) and gives rise to an indirect wave which passes above the first electrode 10 and moves towards the axis of revolution A-A'.

The reflection towards the mold 4 is obtained by virtue of the concave shape of the first wall 8, which causes the pressure waves to converge towards the mold 4. This first wall 8 acts in a manner similar to a concave mirror reflecting rays of light. Thus, the half-angle $\alpha 1$ at the apex of the first frustoconical wall 8 guides the indirect pressure waves towards the axis of revolution A-A' in the direction of the lower portion 38 of the mold 4. The half-angle 2 at the apex of the frustoconical second wall 14 is adapted to send a portion of the indirect pressure waves along the axis of revolution A-A' in the direction of the lower portion 38 of the mold 4.

A direct pressure wave has a direct pressure wave power and an application time on the part to be formed 16. An indirect pressure wave has an indirect pressure wave power and an application time on the part to be formed 16. The application time of a wave corresponds to the time when the pressure corresponding to said wave is applied to the part to be formed.

A moment of pressure (Pa·s), also called pulse, can therefore be determined. It corresponds to an integration over time of the pressure exerted by a pressure wave on the part to be formed 16. The moments of pressure of the direct pressure waves and the moments of pressure of the indirect pressure waves exerted on a given surface of the part to be formed 16 are added.

Due to the characteristics of the first wall 8 and the second wall 14, the part to be formed 16 is subjected to a moment of pressure that can be three times greater than a moment of pressure of an electrohydraulic forming device of the prior art which essentially uses the moments of pressure of direct waves.

By using indirect pressure waves, it is possible to manufacture a part to be formed 16 having given details to be formed or a given form factor, with less stored energy. FIG. 6 shows moments of pressure as a function of the application time of the direct and indirect pressure waves, for different shapes of the tank 6. Curve A shows the moment of pressure for a device of the prior art and curve C shows the moment of pressure for the embodiment described above (FIG. 2).

In another exemplary embodiment (FIG. 3), the half-angle $\alpha 1$ at the apex of the first wall 8 directs the indirect pressure waves towards the axis of revolution A-A' in the direction of the center of the mold 40. The half-angle $\alpha 2$ at the apex of the second wall 14 is adapted to send the indirect pressure waves along the axis of revolution A-A' in the direction of the center of the mold 40.

Confinement of the indirect pressure waves is thus improved, allowing an increase in the total moment of pressure of the pressure wave that can be five times greater than the moment of pressure of an electrohydraulic forming device of the prior art. Curve B (FIG. 6) shows the moment of pressure for the embodiment presented above (FIG. 3).

In another exemplary embodiment (FIG. 4), the tank bottom 24 is pointed, giving a conical shape to the first wall 8. In addition, the first electrode 10 and the second electrode 12 are positioned close to the tank bottom 24 (still on the axis of revolution A-A'). By virtue of the conical shape of the first wall 8 and the slope (angle $\alpha 2$) of the second wall 14, the indirect pressure waves are reflected multiple times by the second wall 14 before being recombined, providing a temporal shift between the direct pressure wave and the various indirect pressure waves.

In another exemplary embodiment, the second wall 14 may be of paraboloid shape in which the dimension h2 (FIG. 5) and the position of its focus are adapted such that the indirect pressure waves are reflected multiple times in order to shift the arrival of the latter onto the part to be formed 16 (FIG. 6; curve D).

In another exemplary embodiment of the invention (not shown), the tank 6 may not have a second wall 14 or an upper portion 20. The mold 4 is then coupled to the first wall 8, making it possible to produce a part to be formed 16 of relatively flat shape.

In all these embodiments, an electric arc is formed substantially parallel to an axis of revolution, thus forming direct pressure waves which are reflected on a concave wall which directs the pressure waves towards the mold and the part to be deformed. The second wall, which is optional, is advantageous however, because it makes it possible to guide the pressure waves after reflection on the first wall with its concavity towards the mold.

An electrohydraulic forming device is thus proposed which enables forming parts with high levels of detail and/or a large form factor. By virtue of the first wall 8 of concave shape and the position of the first electrode 10 and second electrode 12, the part to be formed is primarily formed by indirect pressure waves. The performance of the electrohydraulic forming device according to the invention is improved compared to the performance of devices of the prior art.

The invention is not limited to the embodiments described above by way of non-limiting examples and to the shapes represented in the drawings and to the other variants mentioned, but relates to any embodiment that is within the reach of a person skilled in the art and within the scope of the following claims.

The invention claimed is:

1. An electrohydraulic forming device, comprising:
- a mold,
- a tank containing a fluid and having a first inner wall in contact with the fluid, and
- a first electrode and second electrode both placed in the tank and adapted to generate an electrical discharge to create at least one pressure wave, wherein:
- the first inner wall is rotationally symmetric about an axis extending through the tank,
- the electrodes are coincident with the axis,
- the first inner wall has a concavity oriented towards the mold, and
- the tank comprises a second wall situated between the mold and the first inner wall, wherein the second wall converges toward the mold.

2. The electrohydraulic forming device according to claim 1, wherein the first inner wall is of frustoconical shape.

3. The electrohydraulic forming device according to claim 2, wherein the first inner wall has a half-angle with respect to an apex of the frustoconical shape, the half-angle having a value between 20° and 35° .

4. The electrohydraulic forming device according to claim 1, wherein the electrodes are positioned in the fluid.

5. The electrohydraulic forming device according to claim 4, wherein the fluid is water.

6. The electrohydraulic forming device according to claim 1, wherein the second wall is of frustoconical shape.

7. The electrohydraulic forming device according to claim 6, wherein the second wall has a half-angle with respect to an apex of the frustoconical shape, the half-angle having a value between 20° and 35° .

8. The electrohydraulic forming device according to claim 1, wherein the second wall is of paraboloid shape.

9. The electrohydraulic forming device according to claim 1, wherein the electrodes are arranged in line with one another with an inter-electrode space between them.

10. The electrohydraulic forming device according to claim 1, wherein the first and second electrodes are arranged at respective different heights along the axis.

11. The electrohydraulic forming device according to claim 1, wherein an adjustable inter-electrode space separates the first electrode and the second electrode.

12. The electrohydraulic forming device according to claim 1, wherein the tank is made of a metal or a metal alloy.

13. The electrohydraulic forming device according to claim 1, wherein the first and second electrodes are arranged to produce the electrical discharge substantially parallel to the axis.

14. An electrohydraulic forming device, comprising:

a mold, a tank containing a fluid and having a first inner wall in contact with the fluid, and a first electrode and second electrode both placed in the tank and adapted to generate an electrical discharge to create at least one pressure wave, wherein:

the first inner wall is rotationally symmetric about an axis, the first inner wall is of conical shape;

the first inner wall has a concavity oriented towards the mold;

the first and second electrodes are arranged to produce the electrical discharge substantially parallel to the axis; and the tank comprises a second wall situated between the mold and the first inner wall, wherein the second wall converges toward the mold.

15. The electrohydraulic forming device according to claim 14, wherein the electrodes are arranged in line with one another with an inter-electrode space between them.

16. The electrohydraulic forming device according to claim 14, wherein the first and second electrodes are arranged at respective different heights along the axis.

17. The electrohydraulic forming device according to claim 14, wherein an adjustable inter-electrode space separates the first electrode and the second electrode.

18. The electrohydraulic forming device according to claim 14, wherein the first and second electrodes are positioned on the axis.

* * * * *